US010524631B2

(12) United States Patent
Pfeiffer

(10) Patent No.: US 10,524,631 B2
(45) **Date of Patent: *Jan. 7, 2020**

(54) CLEANING DEVICE WITH A CLEANING ROLLER THAT CAN BE ROTATED AROUND A ROTATIONAL AXIS

(71) Applicant: Vorwerk & Co. Interholding GmbH, Wuppertal (DE)

(72) Inventor: Matthias Pfeiffer, Stolberg (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 155 days.

This patent is subject to a terminal disclaimer.

(21) Appl. No.: 15/739,212

(22) PCT Filed: Jun. 17, 2016

(86) PCT No.: PCT/EP2016/064054

§ 371 (c)(1),
(2) Date: Dec. 22, 2017

(87) PCT Pub. No.: WO2016/207077

PCT Pub. Date: Dec. 29, 2016

(65) Prior Publication Data

US 2018/0168418 A1 Jun. 21, 2018

(30) Foreign Application Priority Data

Jun. 23, 2015 (DE) ..... 10 2015 110 025

(51) Int. Cl.
*A47L 11/40* (2006.01)
*A47L 11/14* (2006.01)

(52) U.S. Cl.
CPC ..... *A47L 11/4041* (2013.01); *A47L 11/14* (2013.01); *A47L 11/4013* (2013.01); *A47L 11/4083* (2013.01)

(58) Field of Classification Search
CPC .. A47L 11/4041; A47L 11/4083; A47L 11/14; A47L 11/4013; A47L 11/282;
(Continued)

(56) References Cited

U.S. PATENT DOCUMENTS 8,555,446 B2 10/2013 Moes et al.
2011/0219555 A1 9/2011 Field et al.

FOREIGN PATENT DOCUMENTS

DE 20 2007 017 026 U1 4/2009
DE 20 2009 013 813 U1 3/2010
GB 903 786 A 8/1962

OTHER PUBLICATIONS

International Search Report of PCT/EP2016/064054, dated Oct. 6, 2016.

(Continued)

*Primary Examiner* — Shay Karls
(74) *Attorney, Agent, or Firm* — Collard & Roe, P.C.

(57) ABSTRACT

A floor-cleaning device has a cleaning roller for processing a surface to be cleaned. The cleaning roller is designed as a hollow body having an internal liquid space. The hollow body has at least one opening for liquid to exit the liquid space. In order to convey liquid to the surface of the hollow body under certain conditions only, the hollow body opening is associated with a force-actuated automatic valve element which, depending on the amount of centrifugal force acting upon the valve element, can be moved to a closing position in which the hollow body opening is closed and/or to an open position in which the hollow body opening is exposed. The valve element allows liquid to exit the liquid space at a first speed of the cleaning roller and to block liquid from exiting when the rotational speed increases.

10 Claims, 2 Drawing Sheets

(58) Field of Classification Search
CPC .. A47L 11/4088; A47L 11/185; A47L 11/125; A47L 11/085
See application file for complete search history.

(56) References Cited

OTHER PUBLICATIONS

International Search Report of PCT/EP2016/062550, dated Jul. 22, 2016.

CLEANING DEVICE WITH A CLEANING ROLLER THAT CAN BE ROTATED AROUND A ROTATIONAL AXIS

CROSS REFERENCE TO RELATED APPLICATIONS

This application is the National Stage of PCT/EP2016/064054 filed on Jun. 17, 2016, which claims priority under 35 U.S.C. § 119 of German Application No. 10 2015 110 025.8 filed on Jun. 23, 2015, the disclosures of which are incorporated by reference. The international application under PCT article 21(2) was not published in English.

AREA OF TECHNOLOGY

The invention relates to a cleaning device, in particular to a floor-cleaning device, comprising a cleaning roller that can be rotated around a rotational axis for processing a surface to be cleaned, wherein the cleaning roller is designed at least partly as a hollow body having an internal liquid space, wherein the hollow body has at least one hollow body opening for liquid to exit the liquid space.

PRIOR ART

Cleaning devices of the aforementioned kind are known in prior art. For example, publication DE 20 2007 017 026 U1 discloses a floor cleaning device with a cleaning roller designed as a damping roller, which is supplied with cleaning liquid from inside. To this end, the cleaning roller has a liquid-permeable hollow body. In order to moisten a cleaning cloth applied from outside onto the cleaning roller, the latter is provided with openings, e.g., in the form of holes, slits, bores and the like. The cleaning cloth and/or a sponge body potentially arranged between the hollow body and cleaning cloth is absorbent in design, so that liquid is permanently aspirated from the hollow body through the openings. The contact pressure while displacing the cleaning device over the surface to be cleaned conveys the liquid from the cleaning cloth or sponge body to the surface to be cleaned.

The disadvantage here is that liquid is permanently dispensed onto the surface of the hollow body, i.e., also onto the cleaning cloth and/or sponge body. As a consequence, liquid is also dispensed even when the cleaning roller is precisely not being used for a cleaning process, but rather only being transported, for example, and also always while the cleaning roller is rotating. This makes a targeted reduction in the dispensed quantity of liquid impossible, in particular as speed increases.

SUMMARY OF THE INVENTION

Therefore, the object of the invention is to provide a cleaning device in which liquid is only conveyed out of the liquid space onto the surface of the hollow body under specific conditions. In particular, the goal is not simply to dispense more liquid when increasing the speed of the cleaning roller. Rather, the goal is also to be able to dispense less liquid even when increasing the speed.

In order to achieve this object, the invention proposes that the hollow body opening have allocated to it a force-actuated automatic valve element which, depending on the amount of centrifugal force made to act on the valve element by a rotation of the cleaning roller, can be moved into a closing position that closes the hollow body opening and/or into an open position that exposes the hollow body opening, wherein the valve element is designed to allow liquid to exit the liquid space at a first speed of the cleaning roller, and to block liquid from exiting as the rotational speed increases once a second speed higher than the first speed has been reached.

The configuration according to the invention not only causes more liquid to be dispensed from the liquid space when increasing the speed of the cleaning roller. Rather, the hollow body opening can also be closed again as a function of speed. In this way, a limited speed range can be created in a targeted manner, in which liquid, in particular a specific quantity thereof, is dispensed from the liquid space. This speed range is limited by the first speed and second speed. Using the centrifugal force that attacks the valve element during the rotation of the cleaning roller, the valve element is here arranged and configured on the hollow body in such a way that the hollow body opening is open given a rotation at below a defined speed, and then closed by means of the valve element as the speed increases once this speed has been reached.

In particular, it is proposed that the valve element have allocated to it a restoring element, in particular a spring, and/or that the valve element be designed as a restoring element, wherein the restoring force of the restoring element acts against the centrifugal force toward the open position. According to the invention, it depends on the centrifugal force attaching the valve element and the restoring force of the restoring element as to whether or not liquid is dispensed from the liquid space onto the surface of the hollow body. It is here known that a speed-dependent centrifugal force acts both on the valve element and on the liquid acting against the valve element during a rotation of the cleaning roller. As soon as the centrifugal force outweighs the restoring force of the restoring element, the valve element closes the hollow body opening, so that liquid can no longer exit through this hollow body opening. The centrifugal force here acting on the valve element depends on the mass of the attacking liquid, the mass of the valve element, the distance between the liquid or valve element and the rotational axis of the cleaning roller and the speed of the cleaning roller. Once a centrifugal force defined by the parameters for the cleaning roller and liquid has been reached, the hollow body opening is blocked by the valve element. The valve element is here moved from the open position into the closed position. Given otherwise constant parameters, whether the valve element moves from the open position into the closed position and vice versa depends exclusively on the speed of the cleaning roller. The second speed is here defined as the minimum speed, which when reached causes the valve element to move into the closed position, and thus blocks liquid from exiting from the liquid space through the hollow body opening. Such a valve element can basically be allocated to all or only certain hollow body openings. It is recommended that the quantity of liquid inside of the liquid space be held constant, i.e., that a corresponding quantity of liquid be refilled when dispensing liquid from the liquid space. If the defined second speed has not (yet) been reached, i.e., the cleaning roller rotates at a lower speed, the liquid can get out of the liquid space and onto the surface of the hollow body. As a consequence, adjusting the speed of the cleaning roller makes it possible to control when liquid does and does not exit the hollow body in a targeted manner.

During the mere transport of the cleaning device, when the cleaning roller essentially does not turn, in particular not actively, liquid can also be prevented from exiting the liquid space by having the hollow body opening exhibit a specific diameter, which does not allow any liquid to exit the liquid space during standstill or at very low speeds (standstill speed). During a cleaning process, however, the used speed exceeds this standstill speed, so that liquid can exit the liquid space provided the speed does not simultaneously also exceed the defined higher second speed at which the valve element again blocks the hollow body opening, and thereby prevents liquid from exiting.

The restoring element allocated to the valve element can advantageously be a spring. Alternatively, however, the valve element can itself be designed as a restoring element. Essential to the invention is that the restoring force of the restoring element act opposite the centrifugal force toward the open position. If the restoring element is designed separately from the valve element, the restoring element can be configured as a separate compression spring, tension spring, torsion spring or the like, for example. Alternatively, however, the valve element can itself be designed as a restoring element, wherein the valve element consists of an elastic material, for example, which is at least partly deformed and/or displaced by the centrifugal force. For example, the valve element can also have a film hinge.

It is proposed that the valve element have at least one closing element pivoted to the hollow body. This pivotably arranged closing element can be a pivotable valve flap arranged on the edge area of the hollow body bordering the hollow body opening. The valve flap is advantageously located inside of the liquid space of the cleaning roller. The valve element can either have only one pivotably arranged closing element, i.e., for example just one valve flap, or several closing elements. The closing element or closing elements can here be displaced radially inward or radially outward relative to the surface of the hollow body, so that they abut flush against the outer or inner surface of the hollow body. The pivotable closing element can also be a separate closing element fastened to the hollow body, or be integrally designed with the hollow body, e.g., as a film hinge, elastic edge area of the hollow body or the like.

Furthermore, it can be provided that the valve element have a linearly movable, in particular slideable, closing element arranged on the hollow body. In the open position of the valve element, the closing element is arranged inside of the hollow body spaced apart from the hollow body opening, and can be led up to the hollow body opening via by moving perpendicularly to the plane of the hollow body opening. In particular, it is proposed that the closing element be arranged on a free end area of a restoring element, in particular of a spring, whose restoring force acts against the plane of the hollow body opening. Once a specific level of centrifugal force has been reached, the closing element is thus led up to the hollow body opening against the restoring force of the restoring element, so that the hollow body opening is closed by means of the closing element.

In addition, it is proposed that the closing element be a plug element that can be displaced at least partly into the hollow body opening. The plug element thus closes the hollow body opening not only from outside, but is rather at least partly also shifted into the hollow body opening, so that a fluid-tight connection is achieved between the plug element and hollow body. As mentioned above, this plug element is advantageously connected with the restoring element, and can be moved from the open position into the closed position due among other things to the centrifugal force that depends on its mass.

In particular, it is proposed that the hollow body opening and closing element be designed so as to correspond to each other in terms of shape. It is here especially advantageous that the effect of a cork in a bottle neck can be achieved when connecting the plug element with the hollow body. It is here especially recommended that the plug element be made at least in part out of a flexible material, so as to achieve an optimal sealing effect.

In addition, it is proposed that the first speed at which liquid can exit the hollow body opening be determined by an equilibrium of forces between a capillary force attacking the liquid and a centrifugal force attacking the liquid. Liquid is blocked from exiting through the hollow body opening below the first speed determined by the equilibrium of forces, while liquid can exit once the minimum speed has been reached. As a consequence, the cleaning roller must first reach a first speed to allow liquid to exit. This is based on the knowledge the liquid located in the liquid space is exposed to a capillary force on the one hand, and—as the cleaning roller rotates—to a centrifugal force. As a result of the capillary force, the liquid located in the liquid space rises in hollow body openings designed as capillaries under specific conditions, and thus can make its way to the surface of the hollow body. This effect is caused by the surface tension of the liquid and the interfacial tension between the liquid and the inner wall of the hollow body opening. Given liquids that wet the material of the surface, the liquid inside the capillary rises, and thereby forms a concave interface (meniscus). By contrast, there also exist liquid-surface combinations in which the liquid does not wet the surface. In this case, the liquid forms a concave surface in the capillary, and the capillary force opposes the centrifugal force. This centrifugal force acts radially outward from the rotational axis, i.e., toward the hollow body opening, so that the liquid can exit from the liquid space onto the surface depending on the correlation of forces between the capillary force and centrifugal force.

In particular, it is proposed that an inner wall of the hollow body opening be hydrophobic in design. When using water, the hydrophobic material of the hollow body is not wetted, so that the capillary force and centrifugal force go in opposite directions, so that the equilibrium of forces between the capillary force and centrifugal force can be used to calculate the first speed as the minimum speed required for the centrifugal force to exceed the radially inwardly acting capillary force, thus allowing the liquid to make its way from the liquid space onto the surface of the hollow body. For example, the hydrophobic material can be PTFE (polytetrafluoroethylene), wax, paraffin or the like. The hollow body can here either itself be made out of the hydrophobic material, at least in the area of the hollow body openings, or be coated with the hydrophobic material. As a result of the hydrophobic property of the hollow body, the water inside of the hollow body opening has a contact angle of greater than 990° relative to the inner wall of the hollow body opening, so that the capillary force goes toward the liquid space, and thus opposes the centrifugal force. This can give rise to the equilibrium of forces described above between the capillary force and centrifugal force. In order to achieve the capillary effect, the hollow body openings can preferably have a diameter of 0.5 μm to 2 mm. These diameters are small enough to prevent the liquid located inside of the liquid space from already being able to exit the liquid space through the hollow body openings solely due to gravitational force. In addition, openings with such a diameter also have a strong enough capillary effect, i.e., enough of a rise in liquid inside of the hollow body opening, to enable the operating principle according to the invention.

In an embodiment of the invention, the cleaning roller has at least two hollow body openings with diameters that differ from each other. A specific minimum speed for the liquid to exit is here allocated to a hollow body opening with a first diameter, and another minimum speed to a hollow body opening with a second diameter deviating therefrom. As a result, for example, a hollow body opening with a first diameter is initially blocked, and only released so the liquid can exit once the first speed has been reached. Two or more groups of hollow body openings with varying diameters are therefore possible, which allow water to exit as a function of speed only at a specific speed, provided this speed is less than the second speed defined according to the invention, which determines that the hollow body opening will be closed by means of the valve element.

In particular, it is proposed that the cleaning roller be designed to allow the liquid to exit through a first hollow body opening with a first diameter upon reaching the first speed, and to allow the liquid to exit through a second hollow body opening with a smaller diameter compared to the first hollow body opening upon reaching a higher third speed by comparison thereto, and block the liquid from exiting through the first hollow body opening and/or the second hollow body opening upon reaching a second speed. This configuration makes it possible to establish various speed ranges within which different hollow body openings are open and/or closed, and in the process allow a varying quantity of liquid to exit the liquid space or not. Depending on a current speed, one or several hollow body openings are here opened or closed based on the correlation of forces between the centrifugal force and restoring force of the valve element. For example, liquid can be dispensed through a first hollow body opening at a first speed unequal to zero. If a third speed greater than the first speed has been reached, a hollow body opening with a smaller diameter than the first hollow body opening is opened based on the correlation of forces between the centrifugal force and capillary force. Once a second speed that is either greater or less than the third speed has been reached, one of the hollow body openings can be closed by means of the closing element based on the centrifugal force acting on the valve element. Conceivable in this regard is a plurality of varying embodiments of the hollow body, in which defined speed ranges are established that selectively allow liquid to exit from the liquid space, or even not. As opposed to prior art, the dispensed liquid quantity is not also automatically increased given a growing speed. According to the invention, the quantity of liquid dispensed can also be reduced as the speed increases instead.

BRIEF DESCRIPTION OF THE DRAWINGS

The invention will be explained in more detail below based on exemplary embodiments. Shown on.

DESCRIPTION OF THE EMBODIMENT

Figure 1:
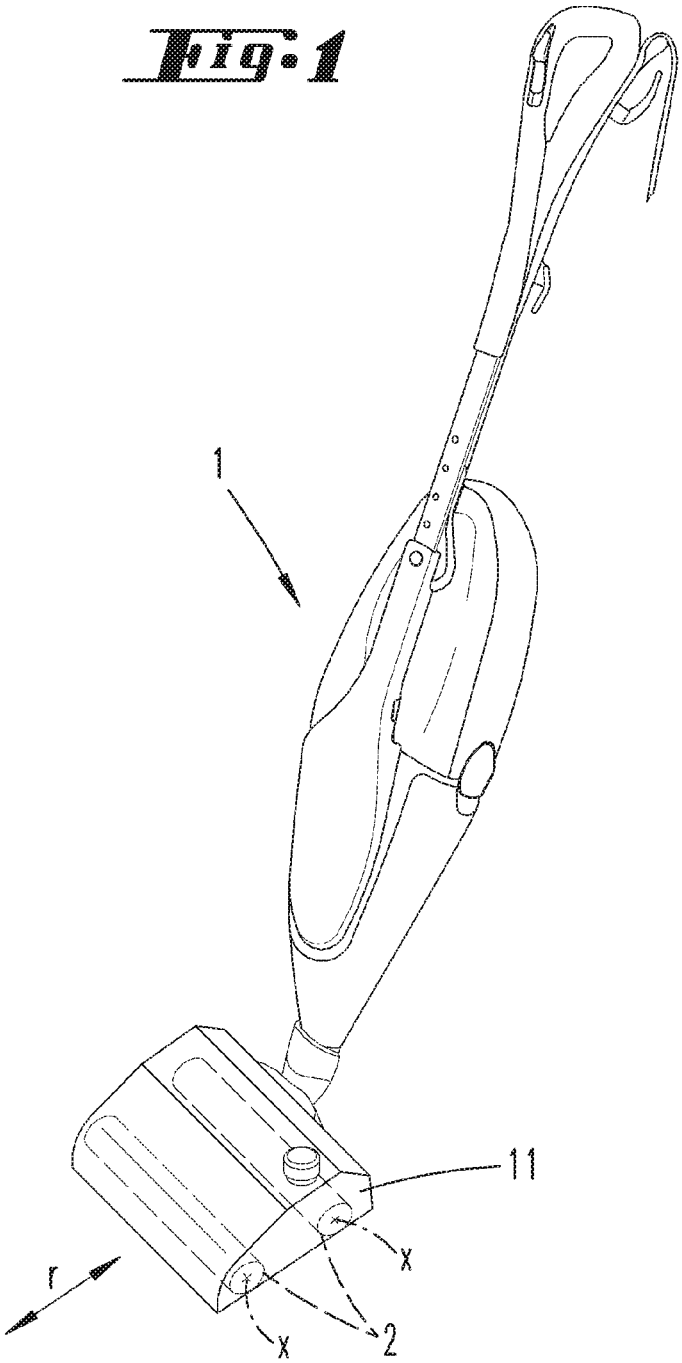
FIG. 1: is a cleaning device according to the invention.

Shown and described initially with reference to FIG. 1 is a cleaning device 1 in the form of a wet cleaning device for wet cleaning a surface to be cleaned. The cleaning device 1 has an attachment 11, which is in contact with the surface to be cleaned in a cleaning process. The attachment 11 here has two cleaning rollers 2, which can be exposed to liquid from inside. To this end, the attachment has a tank (not depicted), which can be exposed to liquid through a filler opening. The liquid makes its way from the tank to the cleaning rollers 2 through liquid lines.

The cleaning device 1 is supported on the surface to be cleaned by the two cleaning rollers 2. The cleaning rollers 2 extend transversely to a usual traversing direction r of the cleaning device 1, which results from the usual working movement of a person using the cleaning device 1, namely alternately to and fro, possibly while slightly deviating into an adjacent cleaning path. The cleaning rollers 2 extend roughly over the entire width of the cleaning device 1 situated transverse to the traversing direction r. According to the arrangement shown, a respective cleaning roller 2 is located on the attachment 11 at the front or back while moving the cleaning device 1. The cleaning rollers 2 can be driven by an electric motor, i.e., rotated around a rotational axis x.

During a conventional traversing process of the cleaning device 1 in which a surface to be cleaned is not processed, the cleaning rollers 2 are not actively driven. Rather, just the frictional connection to the surface to be cleaned itself makes the cleaning rollers 2 passively rotate. By contrast, the cleaning rollers 2 are actively driven by means of the electric motor during the process of cleaning the surface with the cleaning rollers 2 and/or during a self-cleaning of the cleaning rollers 2. During the cleaning process, a wiping edge arises along the line of contact between the cleaning roller 2 and the surface to be cleaned. This wiping edge takes over the cleaning of the surface by being moved relative to the surface, thereby loosening dirt. The cleaning rollers 2 are supplied with a liquid for wet cleaning. The latter is advantageously water, if necessary also provided with a cleaning agent.

Figure 2:
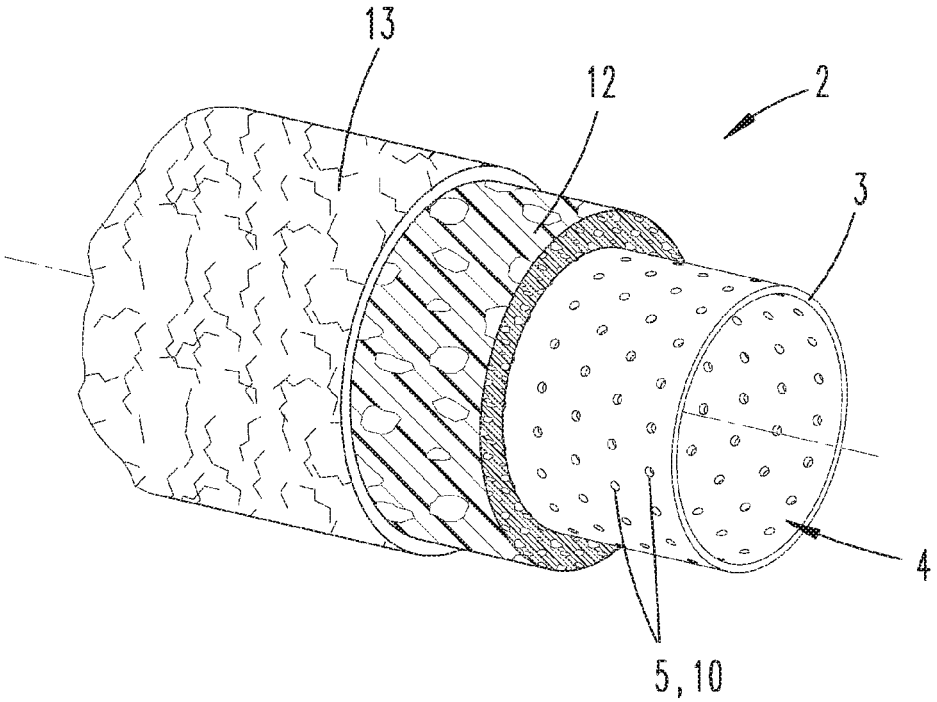
FIG. 2: is an exploded view of a cleaning roller according to the invention.

FIG. 2 shows a detailed view of the cleaning roller 2. The cleaning roller 2 is here depicted in an exploded view in terms of its various casings. The cleaning roller 2 is basically designed as a cylindrical hollow body 3 sealed on the face, wherein the front seal is not shown to provide a better view. The hollow body 3 consists of a rigid plastic material, and is here coated with a hydrophobic material, specifically PTFE. The hollow body 3 is permeable to liquid in design, as it has a plurality of hollow body openings 5, 10 designed as capillaries extending over the surface. Provided inside of the hollow body 3 is an also cylindrical liquid space 4, which serves to hold liquid. Through the hollow body openings 5, 10, liquid can under certain conditions make its way out of the liquid space 4 and onto the surface of the hollow body 3. The hollow body openings 5, 10 have an inner wall 9 that is also coated with a hydrophobic material.

The hollow body 3 is enveloped by a sponge body 12 non-rotatably arranged thereon. The sponge body 12 is open-pore in design, and has the ability to buffer liquid. A cleaning cloth 13 is slipped onto the sponge body 12, here in the form of a microfiber cloth. The cleaning cloth 13, sponge body 12 and hollow body 3 are non-rotatably joined together, and can together be rotated around the rotational axis x. The liquid space 4 of the hollow body 3 serves as a storage unit for the liquid. This storage unit is refilled via the tank described above and the liquid lines. As soon as the sponge body 12 and/or the cleaning cloth 13 is exposed to liquid, the pressure generated by moving the cleaning device 1 on the surface to be cleaned causes it to dispense liquid onto the surface to be cleaned. Liquid here exits in the area of the wiping edge of the cleaning roller 2. The liquid is here squeezed out of the sponge body 12 and/or the cleaning cloth 13 and applied onto the surface to be cleaned by the cleaning cloth 13. As the cleaning roller 2 continues to rotate in the traveling direction r of the cleaning device 1, dirt is loosened from the surface to be cleaned and transferred to the cleaning cloth 13.

Figure 3:
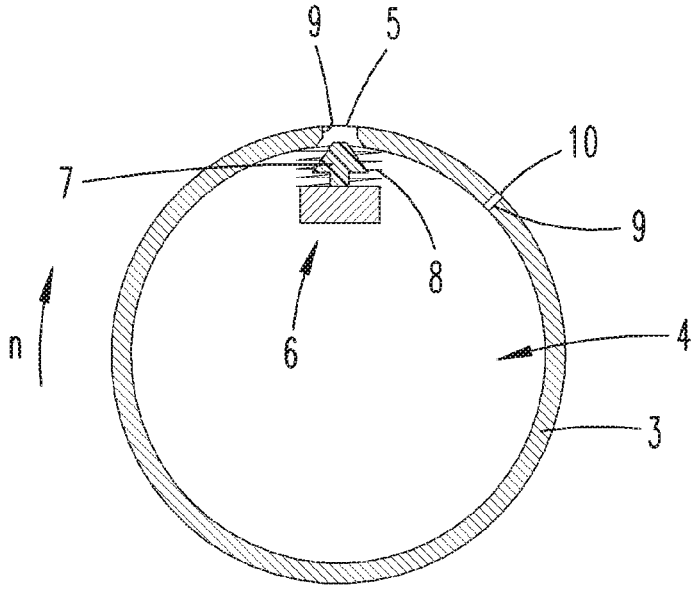
FIG. 3: is a cross sectional view of a hollow body of a cleaning roller.

FIG. 3 shows an embodiment of a cleaning roller 2 designed as a hollow body 3, which has a hollow body with a plurality of hollow body openings 5, 10. Only two hollow body openings 5, 10 are exemplarily depicted to provide a better view. The hollow body opening 5 has a first diameter that is larger than a diameter of a second hollow body opening 10. The first hollow body opening 5 has allocated to it a valve element 6, which has a closing element 7 and a restoring element 8. The valve element 6 is arranged inside of the hollow body 3, so that the closing element 7 can act against the wall of the hollow body 3 and close the hollow body opening 5. The closing element 7 of the valve element 6 is here designed as a plug element that can be at least partly displaced into the hollow body opening 5, and is designed so as to correspond to the inner wall 9 of the hollow body opening 5 in terms of shape. The restoring element 8 is here designed as a helical spring, which connects the hollow body 3 with the closing element 7. The restoring element 8 has a restoring force that tries to space the closing element 7 apart from the hollow body opening 5. In other words, with the cleaning roller 2 in a rotating state, the restoring force acts against the centrifugal force. The second hollow body opening 10 has no closing element 7.

Both hollow body openings 5, 10 are designed as capillaries, so that a capillary force acts against the liquid located inside of the liquid space 4. The capillary force acts radially inward relative to the hollow body 3, since the inner walls 9 of the hollow body openings 5 are hydrophobic in design.

The invention according to FIG. 3 now functions in such a way that a user of the cleaning device 1 fills the cleaning roller 2 with a liquid, here water. The liquid is filled into the liquid space 4 of the hollow body 3, and co-rotated around the rotational axis x while rotating the cleaning roller 2, thereby causing essentially a ring of liquid to form inside of the hollow body 3.

If the user transports or stores the cleaning device 1 outside of a cleaning process, the liquid cannot exit from the hollow body 3 through the hollow body openings 5, 10, since the hydrophobic configuration of the hollow body 3, in particular of the inner wall 4 of the hollow body openings 5, 10, triggers a capillary force directed toward the rotational axis x, which counteracts the rise of liquid in the hollow body openings 5, 10. In addition, the diameters of the hollow body openings 5, 10 are dimensioned so small, e.g., at one millimeter, that the liquid cannot exit from the hollow body 3 even through exposure to gravitational force.

During a cleaning process of the cleaning device 1, the cleaning roller 2 is rotated around the rotational axis x at speed n. If this speed n is greater than or equal to a first speed $n_1$ defined by the parameters for the cleaning roller 2, the centrifugal force attacking the liquid present before the larger hollow body opening 5 exceeds the oppositely directed capillary force, so that liquid can make its way out of the liquid space 4 onto the surface of the hollow body 3 through the hollow body opening 5. By contrast, the hollow body opening 10 has a smaller diameter than the hollow body opening 5, and remains blocked to prevent liquid from passing through, since the capillary force is there still greater at this point in time than the radially outwardly acting centrifugal force. If the speed n of the cleaning roller 2 is now further increased to the second speed $n_2$, the centrifugal force attacking the valve element 6 exceeds the restoring force of the restoring element 8, so that the closing element 7 of the valve element is shifted at least partly into the hollow body opening 5 against the restoring force, wherein the closing element abuts against the inner wall 9 of the hollow body opening in a corresponding manner in terms of shape, and brings about a fluid-tight connection. At this point in time, e.g., corresponding to an acceleration process of the cleaning roller 2 to a conventional operating speed, the surface to be cleaned is exposed to an optimal quantity of liquid, which is required for the continued cleaning process. Proceeding from the above, the cleaning roller 2 is accelerated even more, specifically to a third speed $n_3$, at which the centrifugal force attacking the liquid also exceeds the capillary force in the smaller hollow body opening 10, so that liquid can now make its way out of the liquid space 4 onto the surface of the hollow body 3 through the hollow body opening 10. By contrast, the closing element 7 continues to keep the larger hollow body opening 5 closed. If the cleaning process is now continued at speed n, which is at least as high as the third speed $n_3$, liquid continuously passes through the larger hollow body opening 10 onto the surface to be cleaned.

If it is desired that the surface to be cleaned be exposed to a larger quantity of liquid during the cleaning process, the speed n of the cleaning roller 2 can in turn be reduced to an amount corresponding to a speed n between the first speed $n_1$ and second speed $n_2$, so that the larger hollow body opening 5 is open, and a larger quantity of liquid can be dispensed through these hollow body openings 5. When the cleaning roller 2 is standing still, the centrifugal force attacking the liquid is essentially 0, so that exclusively the capillary force acts on the liquid located inside of the liquid space 4, effectively preventing any dripping from the liquid space 4.

Even though FIG. 3 only shows an embodiment variant of the invention, it goes without saying that additional hollow body openings 5, 10 can also be provided with deviating diameters. In addition, several different valve elements 6 can be provided, whose switching times vary, so that a plurality of varying speed ranges can be generated. Furthermore, it is also possible in the exemplary embodiment shown that the hollow body opening 10 open first, before the hollow body opening 5 is closed by means of the closing element 7.

REFERENCE LIST

1 Cleaning device
2 Cleaning roller
3 Hollow body
4 Liquid space
5 Hollow body opening
6 Valve element
7 Closing element
8 Restoring element
9 Inner wall
10 Hollow body opening
11 Attachment
12 Sponge body
13 Cleaning cloth
d Diameter
n Speed
r Traveling direction
x Rotational axis

The invention claimed is:

1. A cleaning device (1), in particular a floor-cleaning device, comprising a cleaning roller (2) that can be rotated around a rotational axis (x) for processing a surface to be cleaned, wherein the cleaning roller (2) is designed at least partly as a hollow body (3) having an internal liquid space (4), wherein the hollow body (3) has at least one hollow body opening (5, 10) for liquid to exit the liquid space (4), wherein the hollow body opening (5) has allocated to it a force-actuated automatic valve element (6) which, depending on the amount of centrifugal force made to act on the valve element (6) by a rotation of the cleaning roller (2), can be moved into a closing position that closes the hollow body opening (5) and/or into an open position that exposes the hollow body opening (5), wherein the valve element (6) is designed to allow liquid to exit the liquid space (4) at a first speed ($n_1$) of the cleaning roller (2), and to block liquid from exiting as the rotational speed increases once a second speed ($n_2$) higher than the first speed ($n_1$) has been reached.

2. The cleaning device (1) according to claim 1, wherein the valve element (6) has allocated to it a restoring element (8), in particular a spring, and/or wherein the valve element (6) is designed as a restoring element (8), wherein the restoring force of the restoring element (8) acts against the centrifugal force toward the open position.

3. The cleaning device (1) according to claim 1, wherein the valve element (6) has at least one closing element (7) pivoted to the hollow body (3).

4. The cleaning device (1) according to claim 3, wherein the closing element (7) is a plug element that can be displaced at least partly into the hollow body opening (5).

5. The cleaning device (1) according to claim 1, wherein the valve element (6) has a linearly movable, in particular slideable, closing element (7) arranged on the hollow body (3).

6. The cleaning device (1) according to that claim 3, wherein the hollow body opening (5) and closing element (7) are designed so as to correspond to each other in terms of shape.

7. The cleaning device (1) according to claim 1, wherein the first speed ($n_1$) is determined by an equilibrium of forces between a capillary force attacking the liquid and a centrifugal force attacking the liquid.

8. The cleaning device (1) according to claim 1, wherein an inner wall (9) of the hollow body opening (5) is hydrophobic in design.

9. The cleaning device (1) according to claim 1, wherein the cleaning roller (2) has at least two hollow body openings (5) with diameters (d) that differ from each other.

10. The cleaning device (1) according to claim 1, wherein the cleaning roller (2) is designed to allow the liquid to exit through a first hollow body opening (5) with first diameter ($d_1$) upon reaching the first speed ($n_1$), and to allow the liquid to exit through a second hollow body opening (10) with a smaller diameter ($d_2$) compared to the first hollow body opening (5) upon reaching a higher third speed ($n_3$) by comparison thereto, and block the liquid from exiting through the first hollow body (5) opening and/or the second hollow body opening (10) upon reaching a second speed ($n_2$).

* * * * *